US005567009A

United States Patent [19]

Fay et al.

[11] Patent Number: 5,567,009

[45] Date of Patent: Oct. 22, 1996

[54] ROCKING/RECLINING CHAIR HAVING LIMIT MEANS AND NOISE SUPPRESSION MEANS

[75] Inventors: Judy E. Fay, Newport; Larry P. LaPointe, Temperance; Chad S. Stateler, Carleton, all of Mich.

[73] Assignee: La-Z-Boy Chair Company, Monroe, Mich.

[21] Appl. No.: 322,788

[22] Filed: Oct. 13, 1994

[51] Int. Cl.[6] ..... A47C 3/02

[52] U.S. Cl. ..... 297/258.1; 297/266.1; 297/270.1; 297/271.1

[58] Field of Search ..... 297/258, 265, 297/267, 266, 270, 271, 258.1, 261.1, 265.1, 267.1, 266.1, 270.1, 270.3, 271.1, 271.4, 259.1, 259.2, 259.4; 267/166, 167, 169, 33, 248, 151

[56] References Cited

U.S. PATENT DOCUMENTS

| | | | |
|---|---|---|---|
| 37,862 | 3/1863 | Gardiner . | |
| 92,182 | 7/1869 | Gardiner . | |
| 94,101 | 8/1869 | Gardiner . | |
| 203,602 | 5/1878 | Dietsch | 297/266 |
| 214,477 | 4/1879 | Willershausen | 297/266 |
| 345,678 | 7/1886 | Flinn | 297/266 |
| 354,042 | 12/1886 | Connolly | 297/266 |
| 354,043 | 12/1886 | Connolly . | |
| 1,333,801 | 3/1920 | Fitzgerald . | |
| 1,610,770 | 12/1926 | Greene . | |
| 2,469,596 | 5/1949 | Groom . | |
| 2,638,153 | 5/1953 | Clark . | |
| 2,729,273 | 1/1956 | Hamilton et al. . | |
| 3,826,532 | 7/1974 | Caldemeyer . | |
| 4,437,701 | 3/1984 | Mizelle | 297/270 X |
| 4,736,984 | 4/1988 | Tacker . | |
| 4,902,071 | 2/1990 | McGee et al. . | |
| 5,171,000 | 12/1992 | LaPointe et al. | 297/265 X |
| 5,299,786 | 4/1994 | Godin | 267/33 |
| 5,328,235 | 7/1994 | Saul et al. | 297/270 |
| 5,435,622 | 7/1995 | Fay et al. | 297/265 X |

*Primary Examiner*—Laurie K. Cranmer
*Attorney, Agent, or Firm*—Harness, Dickey & Pierce, P.L.C.

[57] ABSTRACT

A rocking chair having a chair frame operable for providing rocking motion relative to a stationary base is provided. The rocking chair generally comprises a chair frame and a stationary base coupled together by a rocker spring assembly. The rocker spring assembly includes an upper and lower bracket having a pair of springs and means for suppressing the noise generated by the springs. The rocker spring assembly further includes means for limiting the rocking movement of the chair frame disposed between the upper and lower bracket of the rocker spring assembly. The present invention further includes means for suppressing the noise generated by other spring elements associated with a reclining or rocking/reclining chair.

16 Claims, 3 Drawing Sheets

FIG 2
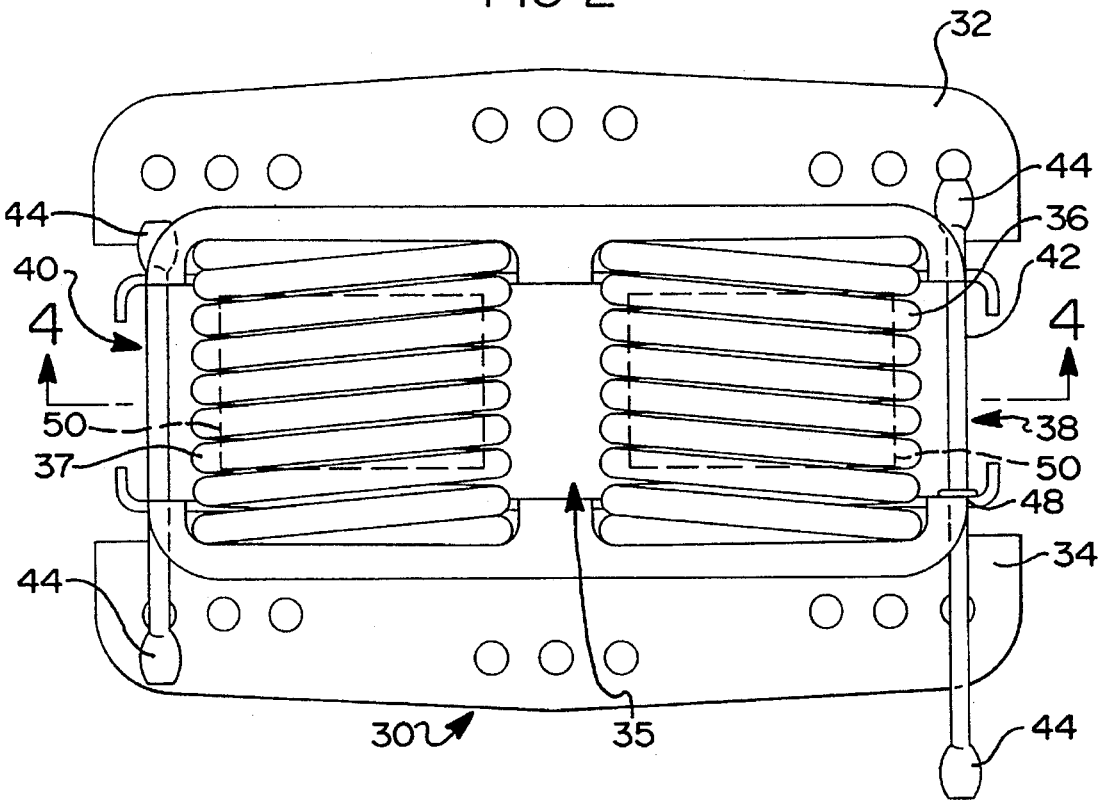
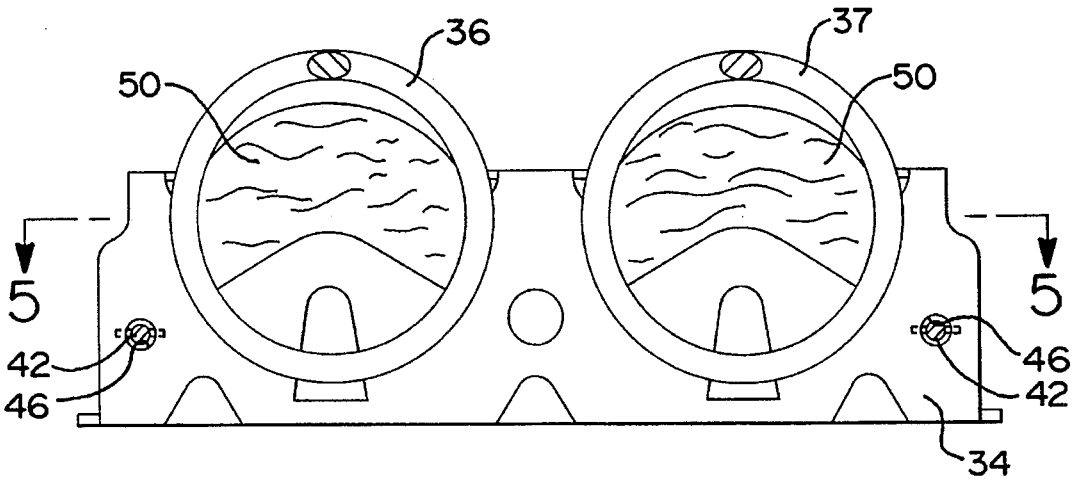
FIG 4

ROCKING/RECLINING CHAIR HAVING LIMIT MEANS AND NOISE SUPPRESSION MEANS

BACKGROUND OF THE INVENTION

1. Technical Field

This invention relates generally to rocking and/or reclining chairs having various spring elements operative during the rocking and reclining operation of the chair, and, more particularly, to noise suppression means for suppressing the noise generated as the chair is rocked and reclined.

2. Discussion

Rocking and reclining chairs often include various spring elements to facilitate the operation of these chairs which have been known to generate disturbing noise as the springs are extended and compressed. Rocking-type chairs typically include a rocker spring assembly between the stationary base and lower structure of the chair frame for biasing the chair in an upright, neutral position while enabling the chair to rock forwardly and rearwardly. As a seat occupant rocks, the chair follows the contour of a rocker block disposed on the chair frame and supported by the stationary base. As the chair is rocked forwardly and rearwardly, the springs associated with the rocker spring assembly are alternately extended and compressed which may cause them to generate undesirable spring noise.

Similarly, reclining chairs often include a pantograph linkage for providing a moveable leg rest assembly. An actuation mechanism enables a seat occupant to position the leg rest assembly from a retracted, stowed position to an protracted, extended position. The actuation mechanism typically includes one or more spring elements for providing mechanical assistance in the protraction and retraction of the leg rest assembly. As the leg rest assembly is extended and stowed, the spring element is extended and compressed which may also generate undesirable spring noise.

An additional source of noise may occur when the rocking chair is rocked too far forward or rearward such that the moveable chair frame contacts the stationary base, or nearby wall, or the floor causing a knocking or bumping sound. Such motion of the chair frame relative to the base can also create an unbalance condition for the chair or create a situation where objects may be trapped or compressed between the chair frame and the base or the floor as the chair is rocked.

It is therefore a principal object of the present invention to provide means for suppressing the noise generated by spring elements associated with a rocking and/or reclining chair.

It is another object of the present invention to provide means for limiting the forward and/or rearward rocking motion of the chair relative to the base.

It is a further object of the present invention to provide means for suppressing the noise generated by spring elements associated with the actuation mechanism of a reclining chair which protracts and retracts the leg rest assembly thereof.

It is still another object of the present invention to provide means for suppressing the noise generated by rocking and/or reclining chairs which can be readily incorporated into an existing chair or included in a new design.

SUMMARY OF THE INVENTION

In a rocking chair, a rocker spring assembly is disclosed generally having an upper bracket coupled to a chair frame, a lower bracket coupled to a stationary base, spring means disposed between and secured to the upper and lower bracket, and means for suppressing the noise generated by the spring means. The means for suppressing the noise includes a selected dampening insert disposed within a coil spring. The present invention further includes a first and second limit rod extending through the upper and lower bracket. Each limit rod includes a shaft portion which allows the upper and lower brackets to move in response to the rocking motion of the chair and an upper and lower stop means disposed on the end of the shaft for preventing further displacement of the upper and lower brackets when a desired rocking limit has been reached. Means for locating the limit rod may also be provided to axially position the limit rod relative to the upper and lower bracket.

In a reclining chair having a spring means operatively associated with an actuation mechanism for operating the reclining of the chair, a means for suppressing the noise generated by the spring means is disclosed including a selected dampening insert disposed within a coil spring for dampening the noise generated as the spring is extended and compressed.

BRIEF DESCRIPTION OF THE DRAWINGS

The various advantages of the present invention will become apparent to one skilled in the art by reading the following specification and subjoined claims and by referencing the following drawings in which:

FIG. 2 is an elevational front view of a rocker spring assembly in accordance with the present invention;

FIG. 4 is an cross-sectional plan view of the rocker spring apparatus taken along line 4—4 of FIG. 2;

DETAILED DESCRIPTION OF THE PREFERRED EMBODIMENT

Figure 1:
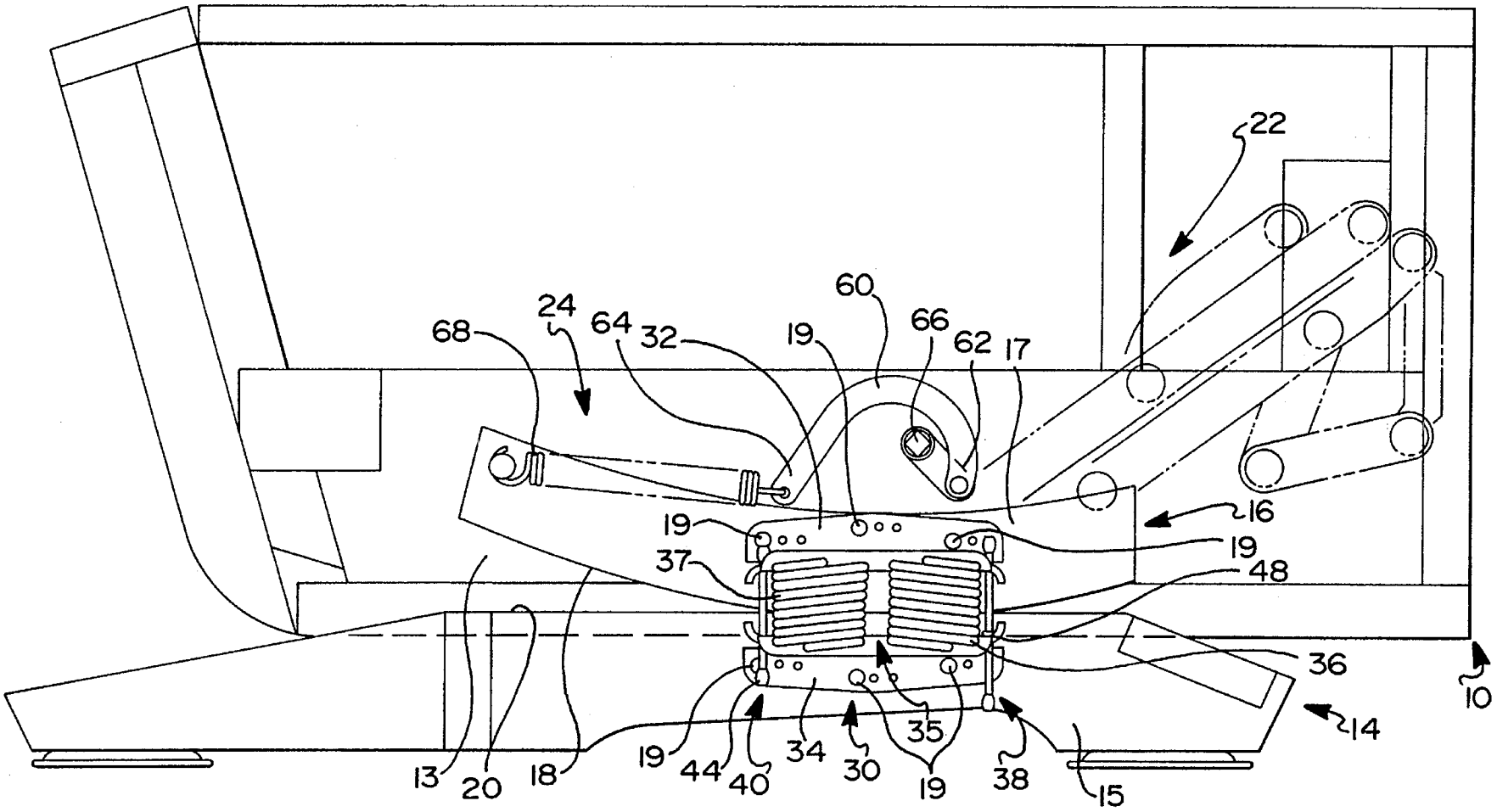
FIG. 1 is a cross-sectional view of a rocking chair taken along a lateral axis of the chair illustrating the chair frame, rocker block, stationary base, rocker spring assembly and actuation mechanism of the present invention; the leg rest assembly is also shown in phantom.

Referring to FIG. 1, a portion of a rocking chair 10, including chair frame 12 and stationary base 14 is illustrated. Wooden rocker block 16 is attached to side portion 13 of chair frame 12 and includes rocking surface 18 which abuts upper surface 20 of stationary base 14 to enable chair frame 12 to rock relative to stationary base 14. The rocking path of chair frame 12 is defined by the contour of rocking surface 18. While the present invention is described with reference to a wooden rocker block, one skilled in the art will appreciate that the present invention could employ other types of rocker blocks without deviating from the scope of the present invention. For example, a plastic rocker block, such as that disclosed in U.S. patent application Ser. No.

08/068,057 commonly assigned to the Assignee of the present invention, could be readily adapted into the present invention.

The present invention includes a pair of rocker spring assemblies 30 laterally located on the right and left hand side of chair 10 for coupling chair frame 12 to base 14. Since right and left rocker spring assemblies 30 are mirror images of each other, only the details of one will be described hereinafter. Referring now to FIGS. 1 and 2, rocker spring assembly 30 includes upper bracket 32 secured to side portion 17 of rocker block 16 with threaded fasteners 19 and lower bracket 34 secured to side rail 15 of stationary base 14 with threaded fasteners 19. Spring means 35 is disposed between and attached to upper bracket 32 and lower bracket 34 for biasing chair frame 12 to an upright, neutral position. Spring means 35 includes front coil spring 36 and rear coil spring 37 transversely positioned relative to chair frame 12 and base 14 and adjacently positioned relative to each other such that their longitudinal axes are parallel. A presently preferred design of the above-identified elements of rocking spring assembly 30 is disclosed in U.S. Pat. No. 5,171,000 entitled "Adjustable Rocker Spring Apparatus" which issued on Dec. 15, 1992 and is commonly owned by the Assignee of the present invention. The disclosure of U.S. Pat. No. 5,177,000 is expressly incorporated by reference herein.

Figure 3:
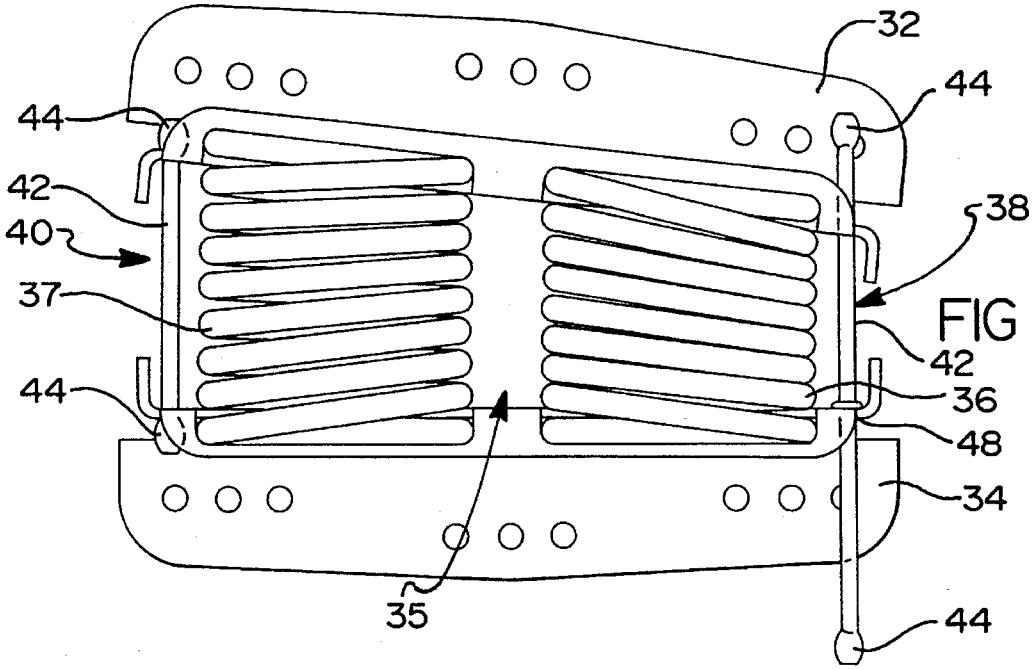
FIG. 3 is an elevational front view of the rocker spring assembly shown in an extended position when the chair frame is rocked relative to the stationary base.

Referring now to FIG. 3, as chair frame 12 is rocked either forward or rearward relative to stationary base 14, upper bracket 32 translates and rotates upwardly and away from lower bracket 34, thus causing coil springs 36, 37 to disproportionately extend. As coil springs 36, 37 are extended most of the spring energy stored therein acts to urge chair frame 12 back to its upright, neutral position. This enables a seat occupant to enjoy rocking movement when desired while allowing chair 10 to return to its conventional orientation when not in use. However, some of the stored energy imparted to coil springs 36, 37 upon extension thereof during rocking may cause the springs to generate unwanted noise.

Figure 5:
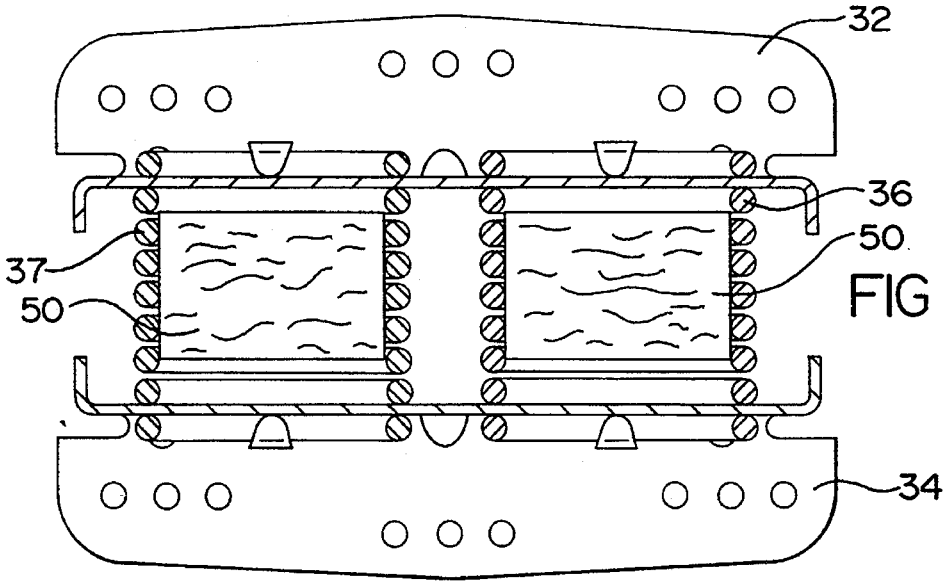
FIG. 5 is a cross-sectional front view of a portion of the rocker spring assembly taken along line 5—5 of FIG. 4 showing the pressed felt insert of the present invention.

Thus, rocker spring assembly 30 includes means for suppressing the noise generated by rocker spring assembly 30 caused by the extension and compression of coil springs 36, 37 when a seat occupant rocks in rocking chair 10. With particular reference to FIGS. 4 and 5, pressed felt insert 50 is disposed within coil springs 36, 37. The size and density of pressed felt insert 50 has been found to be important in achieving optimum noise suppression while maintaining the appropriate operation of rocker spring assembly 30. Accordingly, a felt material meeting SAE standard F13 and having a specific gravity of 18.1% and a nominal thickness of ½ inch is presently preferred to achieve the desired noise suppression effect.

Furthermore, the size of pressed felt insert 50 should be such that it deforms into a semi-circular shape, as best shown in FIG. 4, when it is disposed within coil springs 36 and 37. To achieve this shape, it is desirable that the width of pressed felt insert 50 be approximately 150% of the inner diameter of coil springs 36, 37. In this way pressed felt insert 50 sufficiently engages the individual coils of coil springs 36, 37 to provide adequate noise suppression effect. Furthermore, the oversized nature of pressed felt insert 50 prevents pressed felt insert 50 from falling out of coil springs 36, 37 and becoming separated from rocker spring assembly 30. The length of pressed felt insert 50 should be approximately equal to the length of coil springs 36, 37 in an unloaded condition, thereby again optimizing the noise suppression effect. While various materials having adequate noise suppression, characteristics may be employed to fabricate insert 50, such as various foams or rubber, pressed felt as described above represents a presently preferred material from a cost and availability standpoint.

The present invention further also includes means for limiting the rocking movement of chair frame 12 relative to stationary base 14 to prevent chair frame 12 from contacting base 14, a nearby wall, or the floor and generating an undesired knocking. Such means for limiting the rocking movement of chair frame 12 also function to prevent an unbalance condition of chair 10 or create a situation where objects may be trapped or compressed between chair frame 12 and base 14 or the floor as the chair is rocked. For example, a rear or second limit rod 40 provides a solid stop to prevent forward tipping of chair 10 when a seat occupant lifts his or her legs off of the floor or exits chair 10.

First limit rod 38 and second limit rod 40 cooperate with upper bracket 32 and lower bracket 34 to define a range of rocking movement. Due to the similarity between first limit rod 38 and second limit rod 40, further description will be given with reference only to first limit rod 38. First limit rod 38 includes shaft portion 42 having stop member 44 disposed at each end thereof. Shaft 42 extends through bracket apertures 46 formed in upper bracket 32 and lower bracket 34. Bracket apertures 46 are oversized to allow upper bracket 32 to rotate and translate freely relative to lower bracket 34 during rocking movement without binding on limit rod 38. Stop member 44 is substantially larger than apertures 46 for engaging upper and lower brackets 32, 34 to limit the relative movement of upper bracket 32 relative to lower bracket 34. Stop member 44 further acts to prevent limit rod 38 from becoming disconnected with upper bracket 32 and lower bracket 34. As shown in FIGS. 1–4, stop member 44 is formed by flaring the end portions of shaft 42 perpendicular to upper and lower brackets 32, 34. In this embodiment, at least one stop member 44 of rod 38, 40 is formed in a stamping operation subsequent to the attachment of coil springs 36, 37 to upper bracket 32 and lower bracket 34.

The length of limit rods 38, 40 between stop members 44 determines the range of rocking movement enabled by the limit means of the present invention. In utilizing two limit rods, the present invention enables different limit positions for forward and rearward rocking movement. As best shown in FIG. 2, first limit rod 38, which is located toward the front of chair 10, controls the rearward rocking movement while second limit rod 40, which is located toward the rear of chair 10, controls the forward rocking movement. Typically rocking chair 10 is capable of greater rearward rocking movement before the chair frame contacts the base or floor than forward rocking movements. Accordingly, shaft 42 of first limit rod 38 is longer than shaft 42 of second limit rod 40 to permit greater rearward rocking movement. One skilled in the art would readily recognize that the lengths of limit rods 38, 40 are determined by the contour of rocker block 16, the balance of chair 10, and the range of rocking movement and hence the special relationship between chair frame 12, base 14, the wall and the floor.

In some instances, it is desirable to axially locate limit rods 38, 40. For example, when stationary base 14 of rocking chair 10 permits chair frame 12 to be swivelled or rotated about a vertical axis, limit rods 38, 40 may interfere with portions of stationary base 14 as chair frame 12 swivels. In this situation it is desirable to axially locate limit rods 38, 40 relative to rocker spring assembly 30 to provide clearance between chair frame 12 and stationary base 14. Thus, as shown in FIG. 2, first limit rod 38 may further include locating member 48 disposed on a portion of shaft 42 for positioning first limit rod 38 relative to upper bracket 32 and lower bracket 34. In a presently preferred embodiment, locator member 48 is an O-ring releaseably secured about shaft 42. The inner diameter of O-ring 48 is smaller than the diameter of shaft 42 to frictionally engage shaft 42. The outer diameter of O-ring 48 is larger than the diameter of bracket aperture 46 to prevent O-ring 48 from passing therethrough. Thus, first limit rod 38 may be axially positioned along shaft 42 at a predetermined position to appropriately locate first limit rod 38. This location may be altered by simply repositioning O-ring 48 on shaft 42.

Figure 6:
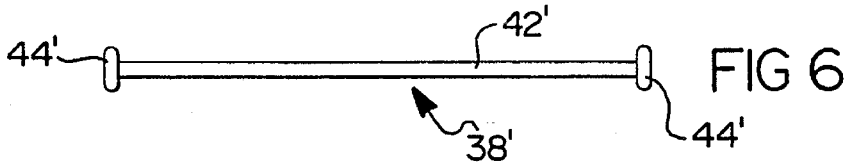
FIG. 6 is a detailed view of an alternate embodiment of a limit rod of the present invention.

Referring now to FIG. 6, an alternate embodiment of first limit rod 38 is shown which includes shaft 42' and stop members 44'. As can be seen from FIG. 6, stop member 44' is formed in the shape of a flat head parallel with upper and lower brackets 32, 34 which may be formed in conjunction with the attachment of coil springs 36, 37 to upper bracket 32 and lower bracket 34. One skilled in the art would readily recognize that other means of providing stop member 44 on the end of shaft 42 could be employed without deviating from the scope of the present invention.

Referring again to FIG. 1, rocking/reclining chair 10 further includes leg rest assembly 22 and actuation mechanism 24 for providing a leg rest assembly which is positionable from a retracted, stowed position to a protracted, extended position. Actuation mechanism 24 and leg rest assembly 22 often include spring means for assisting in the operation of the reclining features of chair 10. U.S. patent application Ser. No. 08/100,915 entitled "Dual Leg Rest Assembly" which was filed on Aug. 9, 1993 and U.S. patent application Ser. No. 5,301,413 entitled "Modular Reclining Chair and Method of Making" which issued on Apr. 12, 1994 provide a more detailed description of the elements and operation of leg rest assembly 22 and actuation mechanism 24. These references are commonly owned by the Assignee of the present invention and are expressly incorporated by reference herein.

Generally, actuation mechanism 24 includes over-center toggle link 60 operatively connected at a first end 62 to drive rod 66. Coil spring 68 is disposed between a second end 64 of toggle link 60 and rocker block 16. Actuation mechanism 24 assists a seat occupant in the protraction and retraction of leg rest assembly 22 by providing mechanical assistance. For example, as leg rest assembly 22 is extended, first end 62 of toggle link 60 is displaced forwardly causing coil spring 68 to extend, thereby storing mechanical energy. Once toggle link 60 passes over the center of drive rod 66, coil spring 68 retracts to provide mechanical advantage in the further protraction of leg rest assembly 22. As with rocker coil springs 36, 37, this extension and retraction may cause coil spring 68 to generate undesirable spring noise during the operation of leg rest assembly 22.

Figure 7:
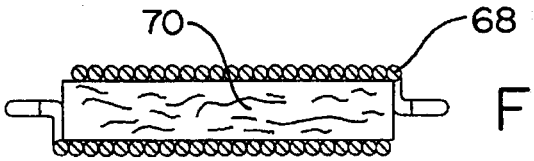
FIG. 7 is a cross sectional view of an actuation mechanism coil spring shown in FIG. 1 illustrating the spring dampening cord of the present invention.

In accordance with the present invention, means for suppressing noise generated by the operation of chair 10 may be included to provide a more quietly operating chair. Referring now to FIG. 7, rocking chair 10 (not shown) further includes means for suppressing the noise that may be generated by coil spring 68. Similar to pressed felt insert 50, spring dampening cord 70 is disposed within the inner diameter of coil spring 68. The dimensions of spring dampening cord 70 have been found to be important to providing adequate noise suppression while maintaining the appropriate operation of coil spring 68. As presently preferred, a cylindrical, cellulose paper welt cord or piping having a diameter slightly less than the inner diameter of coil spring 68 is disposed therein. For example, spring dampening cord 70 having a diameter approximately 80% of the inner diameter of coil spring 68 has been found to provide adequate noise suppression effect. In addition, the length of spring dampening cord 70 should be approximately equal to the unextended length of coil spring 68. While other suitable material may be employed, such as various foam or rubber, it is believed that welt cord or piping, currently used in the fabrication of cushion trim and other upholstered highlights on chairs and other furniture products, is an economical and readily available material for spring dampening cord 70. While spring dampening cord 70 has been described with specific reference to coil spring 68 associated with toggle link 60, one skilled in the art would readily recognize that similar spring dampening cords could be disposed within other spring elements of rocker/reclining chair 10 for suppressing the noise generated thereby without deviating from the scope of the present invention.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to those skilled in the art upon a study of the drawings, specification and following claims:

What is claimed is:

1. A rocking chair comprising:

a base;

a chair frame supported on said base for rocking movement relative to said base;

a rocker spring assembly coupling said base and said chair frame, said rocker spring assembly having an upper bracket secured to said chair frame, a lower bracket secured to said base, spring means disposed between and secured to said upper and lower brackets for biasing said chair frame in an upright, neutral position and for enabling a seat occupant to rock forwardly and rearwardly, and a first and second limit rod disposed between said upper and lower brackets, each of said first and second limit rods having a shaft portion and a stop member disposed at each end of said shaft portion, said upper and lower brackets having apertures formed therethrough for receiving said shaft portion of each of said first and second limit rods such that said stop members are engagable with said upper and lower brackets to define a range of rocking movement; and means for suppressing noise generated by said spring means as said chair frame is rocked.

2. The rocking chair of claim 1 wherein said spring means comprises a coil spring having an inner diameter and said means for suppressing noise comprises a dampening insert disposed within said coil spring.

3. The rocking chair of claim 2 wherein said dampening insert comprises a rectangular insert having a width greater than said inner diameter of said coil spring such that said rectangular insert engages a plurality of coils of said coil spring to suppress noise generated thereby.

4. The rocking chair of claim 2 wherein said dampening insert comprises pressed felt.

5. The rocking chair of claim 1 wherein said apertures formed in said upper and lower brackets are sufficiently oversized to allow said upper bracket to freely rotate and translate relative to said lower bracket as said chair is rocked within said range of rocking movement.

6. The rocking chair of claim 1 wherein said rocker spring assembly further comprises locator means disposed on at least one of said first and second limit rods for axially locating said at least one of said first and second limit rods relative to said rocker spring assembly.

7. The rocking chair of claim 6 wherein said locator means comprises an O-ring releasably retained on said shaft portion of said at least one of said first and second limit rods.

8. A rocking/reclining chair comprising:

a base;

a chair frame supported on said base for rocking movement relative to said base;

a rocker spring assembly coupling said base and said chair frame, said rocker spring assembly having an upper bracket secured to said chair frame, a lower bracket secured to said base spring means disposed between and secured to said upper and lower brackets for biasing said chair frame in an upright, neutral position and for enabling a seat occupant to rock forwardly and rearwardly, and a first limit rod disposed between said upper and lower brackets, said first limit rod having a shaft portion and a stop member disposed at each end of said shaft portion, said upper and lower brackets having apertures formed therethrough for receiving said shaft portion of said first limit rod such that said stop members are engagable with said upper and lower brackets to define a range of rocking movement;

a seat assembly disposed within and suspended from said chair frame, said seat assembly including a seat frame, a seat back and swing link means pivotally interconnecting said seat back and said seat frame for permitting reclining movement of said seat assembly with respect to said chair frame between an upright position and a reclined position;

a leg rest assembly disposed within and suspended from said chair frame, said leg rest assembly positionable between a retracted position and a protracted position;

an actuation mechanism cooperating with said leg rest assembly to protract and retract said leg rest assembly, said actuation mechanism having actuation spring means for providing mechanical assistance in the protraction and retraction of said leg rest assembly;

means for suppressing noise generated by said rocker spring means and said actuation spring means as said chair is operated.

9. The rocking/reclining chair of claim 8 wherein said rocker spring means comprises a rocker coil spring having an inner diameter and said actuation spring means comprises an actuation coil spring having an inner diameter, and said means for noise suppression comprises first dampening insert disposed within said rocker coil spring and a second dampening insert disposed within said actuation coil spring.

10. The rocking/reclining chair of claim 8 wherein said rocker spring assembly further comprises a second limit rod disposed between said upper and lower brackets, said second limit rod having a shaft portion and a stop member disposed at each end of said shaft portion, said upper and lower brackets having apertures formed therethrough for receiving said shaft portion of said second limit rod such that said stop members are engagable said upper and lower brackets to define a range of rocking movement.

11. The rocking/reclining chair of claim 8 wherein said rocker spring assembly further comprises locator means disposed on said limit rod for axially locating said limit rod relative to said rocker spring assembly.

12. The rocking chair of claim 11 wherein said locator means comprises an O-ring releasably retained on said shaft portion of said first limit rod.

13. The rocking chair of claim 8 wherein said apertures formed in said upper and lower brackets are sufficiently oversized to allow said upper bracket to freely rotate and translate relative to said lower bracket as said chair is rocked within said range of rocking movement.

14. A rocking chair comprising:

a base;

a chair frame supported on said base for rocking movement relative to said base;

a rocker spring assembly coupling said base and said chair frame, said rocker spring assembly having an upper bracket secured to said chair frame, a lower bracket secured to said base, spring means disposed between and secured to said upper and lower brackets for biasing said chair frame in an upright, neutral position and for enabling a seat occupant to rock forwardly and rearwardly, a first and second limit rod disposed between said upper and lower brackets, each limit rod having a shaft portion and a stop member disposed at each end of said shaft portion, said upper and lower brackets having apertures formed therethrough for receiving said shaft portions of said first and second limit rods such that said stop members are engagable with said upper and lower brackets to define a range of rocking movement.

15. The rocking chair of claim 14 wherein said rocker spring assembly further comprises locator means disposed on said first and second limit rod for axially locating said first and second limit rod relative to said rocker spring assembly.

16. The rocking chair of claim 15 wherein said locator means comprises a first and second O-ring releasably retained on said shaft portion of said first and second limit rod respectively.

* * * * *